US008852367B2

(12) United States Patent
Mašek et al.

(10) Patent No.: US 8,852,367 B2
(45) Date of Patent: Oct. 7, 2014

(54) METHOD OF PRODUCTION OF HIGH-STRENGTH HOLLOW BODIES FROM MULTIPHASE MARTENSITIC STEELS

(75) Inventors: Bohuslav Mašek, Kaznějov (CZ); Hana Jirková, Strakonice (CZ); Pavel Hronek, České Velenice (CZ); Ctibor Štádler, Plzeň (CZ); Miroslav Urbánek, Mokrouše (CZ)

(73) Assignee: Zapadoceska Univerzita v Plzni (CZ)

( * ) Notice: Subject to any disclaimer, the term of this patent is extended or adjusted under 35 U.S.C. 154(b) by 0 days.

(21) Appl. No.: 13/364,060

(22) Filed: Feb. 1, 2012

(65) Prior Publication Data

US 2012/0273095 A1 Nov. 1, 2012

(30) Foreign Application Priority Data

Feb. 18, 2011 (CZ) ..... PV 2011-90

(51) Int. Cl.
*C21D 8/10* (2006.01)
*C21D 9/08* (2006.01)

(52) U.S. Cl.
CPC *C21D 8/10* (2013.01); *C21D 9/085* (2013.01); *C21D 2211/008* (2013.01); *C21D 8/105* (2013.01); *C21D 9/08* (2013.01)
USPC ..... 148/593; 148/519; 148/590; 148/654

(58) Field of Classification Search
None
See application file for complete search history.

(56) References Cited

U.S. PATENT DOCUMENTS 7,393,421 B2 * 7/2008 Yang ..... 148/570
2010/0326158 A1 * 12/2010 Stranz et al. ..... 72/56

* cited by examiner

*Primary Examiner* — Deborah Yee
(74) *Attorney, Agent, or Firm* — Hovey Williams LLP

(57) ABSTRACT

A method of production of high-strength hollow bodies from multiphase martensitic steels includes a heating process, a forming process and a cooling process. A heating device heats hollow steel stock to the austenitic temperature of the material from which the stock is made. The stock is then converted by deformation in a forming device into a hollow body having the final shape. A cooling device thereafter cools the hollow body such that the material with the original austenite microstructure refined by deformation during the forming process cools to a temperature at which incomplete transformation of austenite to martensite occurs. The retained austenite stabilization is performed in an annealing device by diffusion-based carbon partitioning within the material from which the hollow body is made. The hollow body is cooled in a cooling device to ambient temperature after stabilization.

8 Claims, 3 Drawing Sheets

METHOD OF PRODUCTION OF HIGH-STRENGTH HOLLOW BODIES FROM MULTIPHASE MARTENSITIC STEELS

This application claims the benefit of Czech Republic Application Serial No. PV 2011-90 filed Feb. 18, 2011, the entire disclosure of which is incorporated herein by reference.

BACKGROUND OF THE INVENTION

1. Field of the Invention

The present technical solution belongs to the area of altering physical properties by means of deformation, which follows the heat treatment used in manufacturing cylindrical bodies.

2. Description of the Prior Art

In technical applications, one benefit of hollow bodies is the better utilization of weight of the material for providing functional properties. In addition to those hollow bodies, in which the cavity is a necessary condition for their function, and which find use in, for example, pipes, pressure vessels, boilers, heat exchangers, springs and other structures, there are a growing number of applications where the primary purpose of the cavity is to save weight and reduce the moment of inertia. Hollow rotating shafts may serve as an example. They are much lighter than solid shafts of identical shape.

Yet, hollow shafts can transmit torque equal to that of solid shafts with identical outer dimensions. In addition, their acceleration and deceleration require much less energy, owing to their low moment of inertia. The better the mechanical properties of the material, the thinner the wall can be—and the higher the efficiency of the mass of the structural element.

Stock for making hollow steel bodies must be first converted to the required shape of the intermediate product and then heat treated to obtain excellent properties including high strength and sufficient toughness. The shape of such intermediate product can be obtained by various methods, e.g. machining, forming, welding or by other techniques.

The weakness of the method which, up to this date, has been used for making hollow bodies or their intermediate products is that it is problematic, technically demanding, complicated in materials terms and costly in achieving the shape and optimum properties. Moreover, the conventional machining methods produce large quantities of waste in the form of chips. Conventional combinations of forming methods or other methods with subsequent additional treatment require multiple heating operations, leading to higher overall energy consumption.

SUMMARY OF THE INVENTION

This invention relates to a method of production of high-strength hollow bodies from multiphase martensitic steels and, in the preferred embodiment, production of hollow shafts.

At the first step, a device for heating is used to heat the hollow metal stock to the austenitic temperature of the material from which the stock is made. The austenitic temperature depends on the particular alloy or type of material, ranging from approx. 727° C. to 1492° C. The preferred embodiment involves a device for heating the hollow stock on the basis of induction heating.

At the next step, the stock is converted by means of deformation in a forming device into a hollow body having the final shape. According to a preferred embodiment, the forming process in the forming device may be carried out using an explosive. In such case, the explosive is inserted into the cavity of the hollow stock placed in the die by means of a holder of explosive. The advantage of explosive forming is that the explosive force and rapidly expanding gasses produce a rapid and uniform deformation throughout the entire hollow stock. The explosion expands the stock inside the die, causing the outer surface of the stock to take the shape of the die cavity faultlessly. The forming device may take the form of a forging machine, rolling machine or another type of metalworking equipment.

Immediately after the forming process, the hollow body having the final shape is cooled in cooling device in such a way that the material with the initial austenite structure that has been refined by deformation introduced during forming is cooled down to a temperature, at which incomplete transformation of austenite to martensite takes place. The cooling device may include, primarily, water sprays or water bath.

Immediately thereafter the hollow body will preferably be transferred to a annealing device. The annealing device may, for example, utilize an oil, salt or polymer bath or annealing furnace. In the annealing device, retained austenite stabilization takes place by carbon partitioning within the material from which the hollow body was manufactured.

Once the stabilization is finished, the hollow body is cooled down to ambient temperature in a cooling device. According to a preferred embodiment, the cooling device may be a cooling conveyor, on which the hollow body is placed. The cooling conveyor may also be utilized as the means of placing the hollow body in the annealing device. In such case, the hollow body having the final shape is placed on the conveyor after the partial transformation of austenite into martensite and transported into the annealing device. After a prescribed period of time, the hollow body is removed from the annealing device by means of a conveyor in the form of a cooling conveyor and is cooled down.

The above heating and controlled cooling process is termed a Q-P process. The Q-P process is a procedure, by which an object is rapidly cooled down from austenitic temperature of the material in question to a temperature between the temperature at which martensite begins to form and the temperature at which martensite formation is finished. This causes the transformation of austenite to martensite to be incomplete. Part of austenite remains in the metastable state and is then enriched and therefore stabilized through diffusion-based redistribution of carbon. This takes place at temperatures slightly above the original temperature of the previous cooling step. After several minutes, the process of diffusion-based stabilization is finished and the product is cooled down to the ambient temperature. This process results in a structure which shows higher residual ductility than structures obtained by conventional processes at the same strength values. The principle is the formation of thin foils of plastic and deformable retained austenite along the boundaries of strong and hard martensite laths or plates. Under overload, retained austenite slows down catastrophic fracture propagation, thus increasing the residual ductility to twice as high value, which may then reach above 10%. The finer the martensite particles, the better mechanical properties can be achieved by this procedure. Since martensite forms within austenite upon cooling, the appearance of the resulting microstructure will depend on the austenite grain size. In the course of conventional heat treatment, the size of grain increases during heating and, at the same time, the size of resulting martensite particles increases. In order to refine these particles, the microstructure of retained austenite needs to be refined. This can only be achieved by forming at appropriate temperature.

BRIEF DESCRIPTION OF THE DRAWINGS

An example of an embodiment illustrating the proposed method of the invention is described with reference to the drawings submitted herewith in which.

DETAILED DESCRIPTION OF AN EMBODIMENT OF THE INVENTION

Figure 1:
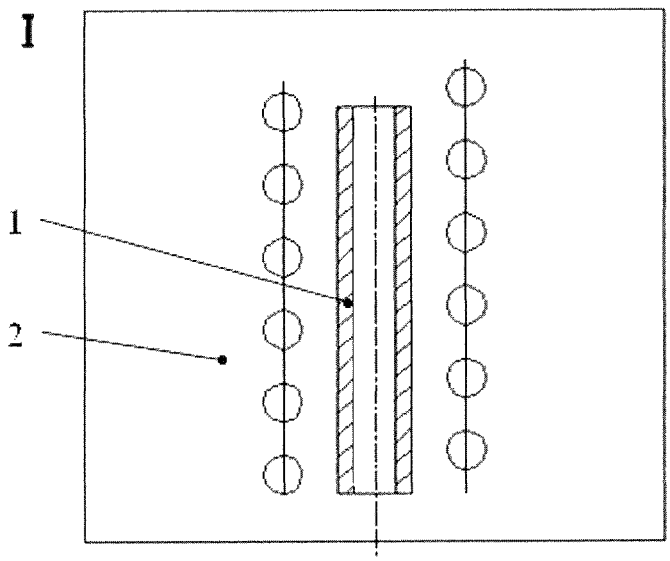
FIG. 1 is a cross-sectional view of a body of initial hollow stock to be converted in accordance with the process of the present invention positioned in operative relationship to a heater.

Referring now to FIG. 1 of the drawings, hollow initial stock 1 is made of metal, preferably steel. For purposes of example, the hollow initial stock 1 may be produced by conventional methods from a steel alloy such as for this example and as identified using Euronorm steel standard nomenclature, from 42SiCr, an alloy having a chemical composition set forth in Tab. 1. The hollow initial stock 1 is heated at the first step (I) to an austenitic temperature, which for the allow of this example is about 910° C. in a device for heating 2. In this case, the device for heating 2 uses the induction heating principle.

Figure 2:
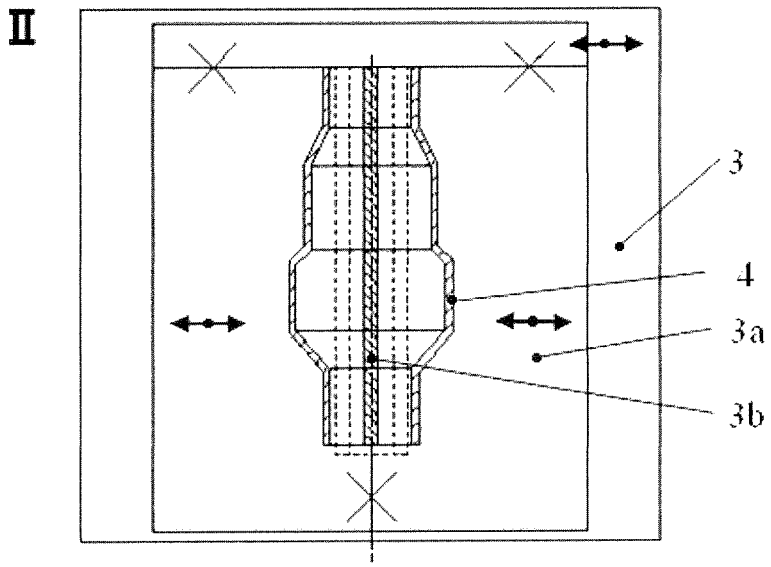
FIG. 2 is a cross-sectional view showing the transformation of the initial hollow stock to a desired final shape in a forming device.
Figure 3:
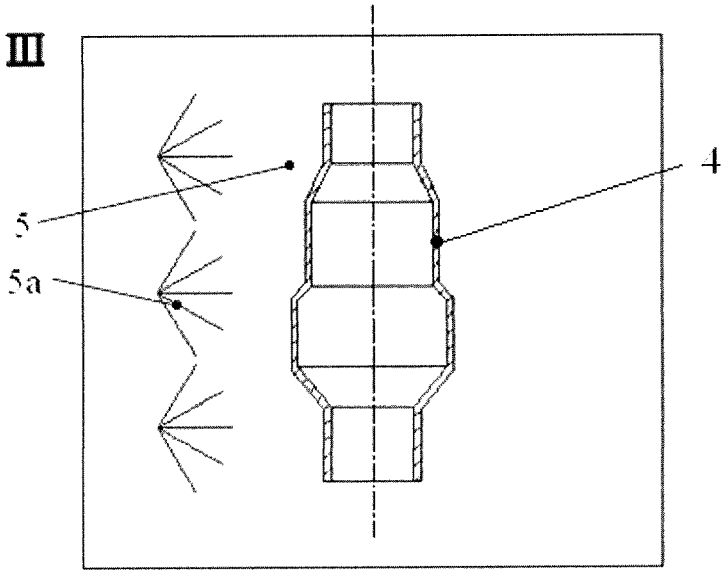
FIG. 3 is a cross-sectional view showing the cooling of the final shape by an initial cooling device.
Figure 4:
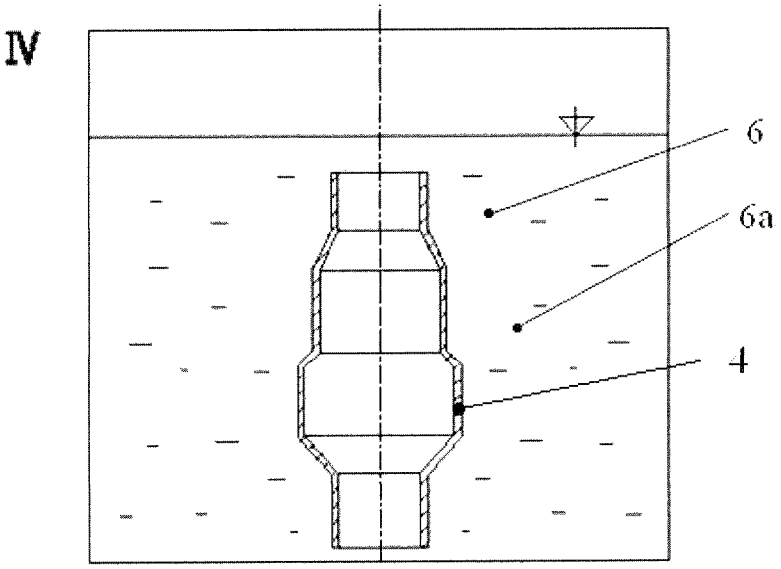
FIG. 4 is a cross-sectional view showing the treatment of the final shape by an annealing device.

At the second step (II) shown in FIG. 2, the stock 1 is transferred to the forming device 3. The forming process in the forming device 3 is carried out using an explosive. By means of a holder of explosive 3*b*, the explosive is inserted into the cavity 3*a* of the hollow stock 1 placed inside the die. The detonation causes the stock 1 having, for example, an initial shape as shown in FIG. 1 and illustrated in broken lines in FIG. 2 to be formed to the final shape 4 of the hollow body, which, for the alloy of this example, occurs preferably at temperatures between about 900° C. and 820° C. At the next step (III) as shown in FIG. 3, immediately after the forming process, the hollow body having the final shape 4 is transferred into an initial cooling device 5. In this embodiment, the initial cooling device 5 comprises water sprays 5*a*. Using the water sprays 5*a* the hollow body of the alloy of this example is initially cooled down to about 200° C. Immediately after cooling, at the next step (IV) as illustrated in FIG. 4, the hollow body is placed in an annealing device 6. According to this embodiment and for this alloy, the annealing device 6 may include a salt bath 6*a* at the temperature of about 250° C. For the alloy of this example and when applied for about 10 minutes, this temperature provides for austenite stabilization.

Figure 5:
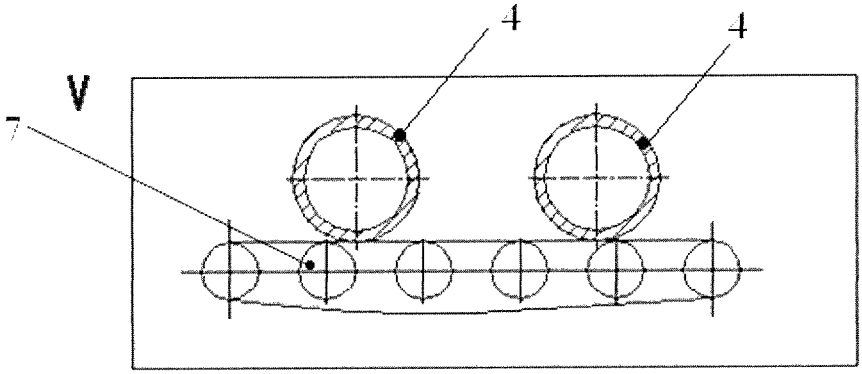
FIG. 5 is a view of a final cooling device carrying two of the final shapes for final cooling.

At the last step (V) illustrated in FIG. 5, the hollow body is removed from the annealing device 6 and cooled down in the second or final cooling device 7 to preferably ambient or room temperature in still air, for example about 20° C. In this case, the second or final cooling device 7 has the form of a cooling conveyor.

TABLE 1

Chemical composition of the material 42SiCr (wt. %)

| C | Si | Mn | Cr | Mo | Al | Nb | P | S | Ni | Cu | Sn |
|---|---|---|---|---|---|---|---|---|---|---|---|
| 0.43 | 2.03 | 0.59 | 1.33 | 0.03 | 0.008 | 0.03 | 0.009 | 0.004 | 0.07 | 0.07 | 0.01 |

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirt of the present invention.

The inventors hereby state their intent to rely on the Doctrine of Equivalents to determine and assess the reasonably fair scope of their invention as pertains to any apparatus or method not materially departing from but outside the literal scope of the invention as set out in the following claims.

LIST OF REFERENCE SYMBOLS

1—hollow stock
2—device for heating
3—forming device
3*a*—die
3*b*—holder of explosive
4—final shape
5—initial cooling device
5*a*—water spray
6—annealing device
6*a*—bath
7—final cooling device

The invention claimed is:

1. A method of producing high-strength hollow bodies from multiphase martensitic steels, where the production includes a heating process, a forming process and a cooling process, comprising the steps of:

heating a body of hollow steel stock to about an austenitic temperature of the steel material from which the body of hollow steel stock is made;

converting the body of hollow steel stock by deformation of the body of hollow steel stock in a forming device into a hollow body having a final shape;

initially cooling the hollow body having the final shape in an initial cooling device after the converting step in such a way that the steel material comprising the hollow body having a final shape and having an original austenite microstructure refined by deformation introduced during the converting step is initially cooled down to a temperature between the temperature at which martensite begins to form and the temperature at which martensite formation is finished, such that incomplete transformation of austenite to martensite takes place and part of austenite remains in a meatastable state, to yield an initially cooled hollow body comprising retained austenite;

immediately after the initial cooling down to the temperature between the temperature at which martensite begins to form and the temperature at which martensite formation is finished, annealing the initially cooled hollow body in an annealing device at a temperature above the initial cooling temperature, whereby retained austenite stabilization is performed in the annealing device by diffusion-based carbon partitioning within the material of the initially cooled hollow body to yield an annealed hollow body; and finally cooling the annealed hollow body to ambient temperature in a final cooling device after the annealing step has finished the retained austenite stabilization, to yield a hollow body having increased residual ductility.

2. The method of production of high-strength hollow bodies from multiphase martensitic steels of claim 1, wherein the converting step in the forming device is carried out using an explosive, and wherein the explosive is placed using the holder of explosive inside a cavity of the hollow stock steel body which is located inside a die of the forming device (3).

3. The method of production of high-strength hollow bodies from multiphase martensitic steels of claim 1 wherein the final cooling device is a cooling conveyor.

4. The method of production of high-strength hollow bodies from multiphase martensitic steels of claim 1 wherein the initial cooling step is performed immediately after the completion of the converting step.

5. The method of production of high-strength hollow bodies from multiphase martensitic steels of claim 1, wherein the initial cooling step is carried out in the initial cooling device which is a different device than the final cooling device.

6. The method of production of high-strength hollow bodies from multiphase martensitic steels of claim 2, wherein the final cooling device is a cooling conveyor.

7. The method of production of high-strength hollow bodies from multiphase martensitic steels of claim 1, wherein the hollow body after the final cooling step comprises plastic and deformable retained austenite along the boundaries of strong and hard martensite.

8. The method of production of high-strength hollow bodies from multiphase martensitic steels of claim 1, wherein said increased residual ductility is above 10%.

* * * * *